United States Patent [19]

Lee

[11] 4,098,125

[45] Jul. 4, 1978

[54] ADJUSTABLE VOLUME PIPETTING DEVICE

[76] Inventor: Thomas E. Lee, 3938 Canyon Rd., Lafayette, Calif. 94549

[21] Appl. No.: 783,051

[22] Filed: Mar. 30, 1977

[51] Int. Cl.[2] ..... B01L 3/02

[52] U.S. Cl. ..... 73/425.6

[58] Field of Search ..... 73/425.4 P, 425.6; 222/309

[56] References Cited

U.S. PATENT DOCUMENTS

| | | | |
|---|---|---|---|
| 1,809,813 | 6/1931 | Kantor | 222/309 |
| 2,530,909 | 11/1950 | Riggs | 73/425.6 |
| 3,334,788 | 8/1967 | Hamilton | 73/425.6 |
| 3,815,790 | 6/1974 | Allen et al. | 222/309 |

*Primary Examiner*—S. Clement Swisher

[57] ABSTRACT

An adjustable volume pipetting device comprising a barrel assembly and a plunger assembly, including a plunger wire, and so constructed that the length of the plunger wire stroke is adjustable while retaining a fixed relationship between the end of the plunger wire and the end of a capillary tube. The novel construction comprises a barrel assembly including an elongated barrel, a sleeve threadably engaged with said barrel and axially adjustable thereon by relative rotation between said barrel and sleeve, a tubular stop coaxially mounted within said sleeve adjacent one end thereof, a capillary tube coaxially mounted in the one end of said sleeve and projecting outwardly from said sleeve and barrel, a slip ring slidably mounted on said barrel adjacent the other end of said sleeve, and a lock nut threadably engaged with said barrel and axially adjustable thereon by relative rotation between said barrel and nut.

4 Claims, 3 Drawing Figures

ADJUSTABLE VOLUME PIPETTING DEVICE

This invention relates generally to pipetting devices, particularly of the kind shown and described in U.S. Pat. No. 3,815,790. The invention more particularly involves a novel construction of pipetting device which permits a precise adjustment in the volume of fluid which may be dispensed.

One object of this invention is to provide an improved construction for a pipetting device which permits volume adjustments with great accuracy.

Another object of the invention is to provide a device of the kind described which is dependable in operation and adapted to be used with replaceable capillary tubes.

A still further object of the invention is to provide an adjustable volume pipetting device wherein the length of the plunger wire stroke may be adjustably set while maintaining a fixed relationship between the end of the plunger wire and the end of the capillary tube.

Other objects of this invention will become apparent in view of the following detailed description.

In the drawings, forming a part of this application, and in which like parts are identified by like reference numerals:

Figure 1:
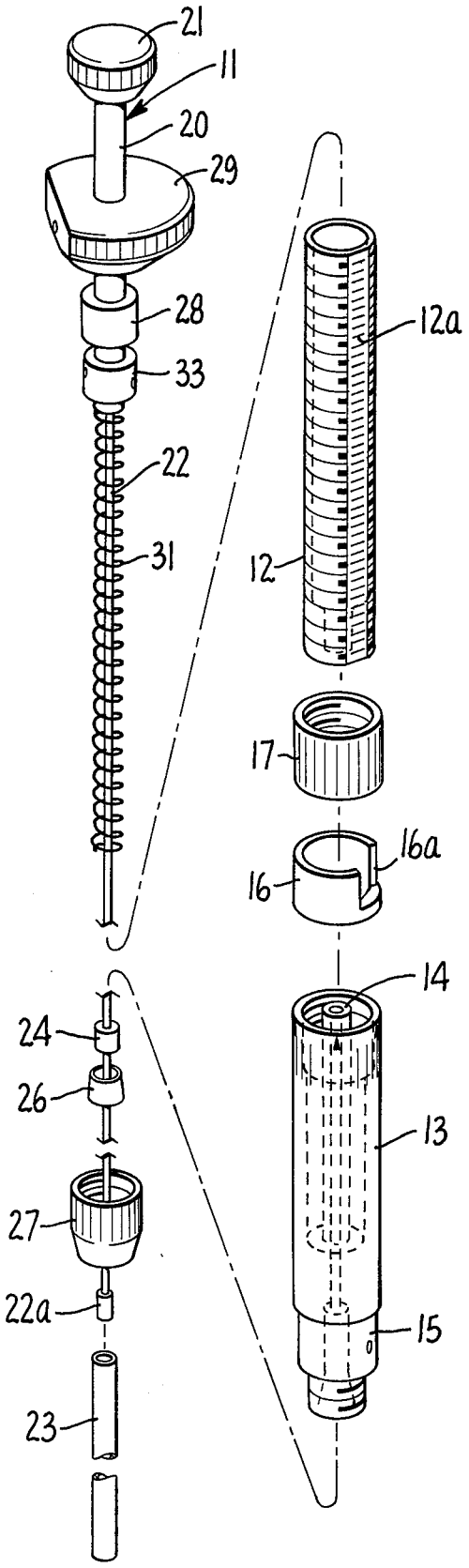
FIG. 1 is an exploded perspective view of a preferred embodiment of the invention.
Figure 2:
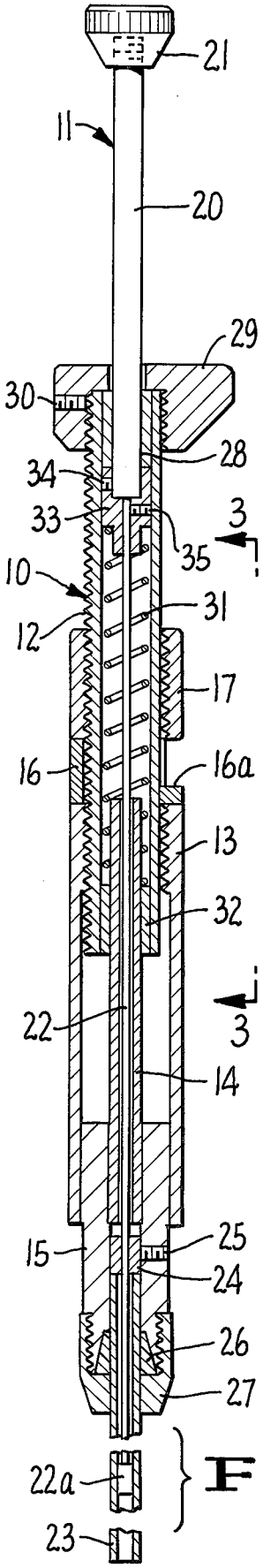
FIG. 2 is a longitudinal section of the embodiment in an assembled condition.
Figure 3:
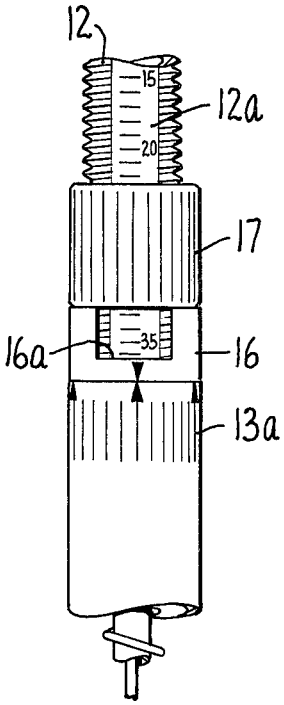
FIG. 3 is an elevational detail of one portion of the device.

Referring to FIGS. 1 and 2 in particular, a preferred embodiment of this invention in an adjustable volume pipetting device comprises a barrel assembly 10 and a plunger assembly 11. Barrel assembly 10 includes an elongated barrel 12 exteriorly threaded along its full length, a sleeve 13 threadably engaged with barrel 12 and axially adjustable thereon by relative rotation between the barrel and sleeve, a tubular stop 14 coaxially mounted within the sleeve by a barrel tip 15, a slip ring 16, slidably mounted on the barrel 12, and a lock nut 17 threadably engaged with the barrel and axially adjustable thereon by relative rotation therebetween. It will be noted that one side of barrel 12 is formed with a land or flat surface **12*a* to which a scale is applied as shown in FIG. 3. The scale is related to the pitch of the threads formed exteriorly on barrel 12, and a reading of the scale through a window 16*a* formed in slip ring 16 determines the volume setting of the instrument. A more precise setting for volume is accomplished by providing a second scale 13*a* on sleeve 13. Scale 13*a* reflects a decimal portion of the axial advance produced by one full rotation of the sleeve along barrel 12**.

Plunger assembly 11 essentially comprises a plunger rod 20 which carries a button 21 at one end and a plunger wire 22 at the opposite end. In the assembled condition, plunger 22 extends coaxially through tubular stop 14 and barrel tip 15 and into a capillary tube 23 mounted in the end of barrel tip 15. The mounting arrangement of the capillary tube in the barrel tip is essentially identical with a construction shown in U.S. Pat. No. 3,815,790. That construction provides means for replacing capillary tubes while precisely positioning such tubes axially relative to the barrel assembly, and comprises the pipette stop 24, a conical seat 26 and a collet 27 threadably secured to the end of barrel tip 15.

As shown in FIG. 2, a spacer collar 28 is disposed within the upper end of barrel 12 and is retained therein by a barrel cap 29 and a set screw 30. Spacer collar 28 serves as a stop which limits the upward travel of the plunger assembly. A spring 31 disposed within barrel 12 and confined between a spring seat 32 and a plunger tip 33 urges the tip into contact with the end of collar 28. Plunger tip 33 is secured to the plunger rod by a set screw 34. A second set screw 35 secures plunger wire 22 to the plunger tip.

In operation, the device is assembled and adjusted in the following manner: The device is first adjusted and set to a particular calibration volume by moving lock nut 17, slip ring 16 and sleeve 13 axially along barrel 12. The capillary tube 23 and stop 24 are then adjustably positioned in the barrel tip 15 thus calibrating the device. The device may then be adjusted for larger or smaller volumes by backing off lock nut 17; rotating sleeve 13 to a new axial position along barrel 12; and sliding slip ring 16 against the end of sleeve 13. When the setting of sleeve 13 is properly adjusted (by reference to the scales **12*a* and 13*a*), lock nut 17 is then tightened down against slip ring 16**.

It will be noted that an adjustment of sleeve 13 produces a simultaneous axial adjustment of the tubular stop 14 as well as the capillary tube 23. Accordingly, the relative axial position of plunger wire 22 within capillary tube 23 is maintained for each position of adjustment at times when the plunger assembly is fully depressed and while plunger tip 33 contacts the end of tubular stop 14. This feature provides a device having the capability of adjusting the dispensing volume without requiring a resetting of the capillary tube or a change in calibration.

Although a preferred embodiment of the invention has been illustrated and described, various modifications and changes may be resorted to without departing from the spirit of the invention or the scope of the appended claims, and each of such modifications and changes is contemplated.

What is claimed is:

1. An adjustable volume pipetting device comprising:

a barrel assembly including an elongated barrel having an outer thread and a scaled surface, a sleeve threadably engaged with said barrel and axially adjustable thereon by relative rotation between said barrel and sleeve, a tubular stop coaxially mounted relative to said sleeve and axially movable therewith, a capillary tube coaxially mounted relative to said barrel and sleeve at one end of the device, a slip ring axially slidable on said barrel adjacent one end of said sleeve, said slip ring having a window through which the scaled surface of said barrel may be viewed, and a lock nut threadably engaged with said barrel and axially adjustable thereon by relative rotation between said barrel and nut;

a plunger assembly carried in part within the barrel assembly including a reciprocating plunger and plunger wire, said plunger wire extending through said tubular stop and into said capillary tube;

and stop means engageable with said tubular stop while said plunger wire is being moved in said capillary tube;

whereby the length of said plunger wire stroke is adjustably set by selectively positioning the tubular stop relative to the barrel by reference to said scaled surface and slip ring, the axial position of said plunger wire within said capillary tube being fixed for each position of sleeve adjustment when said stop means contacts said tubular stop.

2. An adjustable volume pipetting device comprising:

a barrel assembly including an elongated barrel having an outer thread and a scaled surface, a sleeve threadably engaged with said barrel and axially adjustable thereon by relative rotation between said barrel and sleeve, a tubular stop coaxially mounted within said sleeve adjacent one end thereof, a capillary tube coaxially mounted in the one end of said sleeve and projecting outwardly from said sleeve and barrel, a slip ring axially slidable on said barrel adjacent the other end of said sleeve, said slip ring having a window through which the scaled surface of said barrel may be viewed, and a lock nut threadably engaged with said barrel and axially adjustable thereon by relative rotation between said barrel and nut;

a plunger assembly carried in part within the barrel assembly including a reciprocating plunger and plunger wire, said plunger wire extending through said tubular stop and into said capillary tube;

and stop means carried by said reciprocating plunger engageable with said tubular stop while said plunger wire is being moved in said capillary tube;

whereby the length of said plunger wire stroke is adjustably set by selectively positioning the sleeve relative to the barrel by reference to said scaled surface and slip ring, the axial position of said plunger wire within said capillary tube being fixed for each position of sleeve adjustment when said stop means contacts said tubular stop.

3. The adjustable volume pipetting device of claim 2, and further comprising a spacer collar mounted within said barrel, the most inner end of said collar providing a stop limiting movement of said plunger assembly in a direction away from said tubular stop; stop means formed on said plunger assembly engageable with said spacer collar; and a return spring disposed within said barrel assembly, said spring resiliently urging said stop means into contact with said spacer collar.

4. The adjustable volume pipetting device of claim 3, said barrel assembly including a tubular spring seat mounted within one end of said elongated barrel; and a barrel cap threadably engaged with the other end of said elongated barrel.

* * * * *